US008354154B2

(12) United States Patent
Mason et al.

(10) Patent No.: US 8,354,154 B2
(45) Date of Patent: Jan. 15, 2013

(54) HEAT SEALED APPLIQUÉ HAVING ADHESIVE COATED PERIMETER

(76) Inventors: Patricia A. Mason, White Hall, MD (US); Paul Weedlun, Ellicott City, MD (US)

( * ) Notice: Subject to any disclaimer, the term of this patent is extended or adjusted under 35 U.S.C. 154(b) by 298 days.

(21) Appl. No.: 12/781,053

(22) Filed: May 17, 2010

(65) Prior Publication Data

US 2010/0291336 A1 Nov. 18, 2010

Related U.S. Application Data

(60) Provisional application No. 61/216,350, filed on May 15, 2009.

(51) Int. Cl.
*B32B 3/16* (2006.01)

(52) U.S. Cl. ..... 428/61; 428/102; 428/138

(58) Field of Classification Search ..... 428/61, 428/102, 138
See application file for complete search history.

(56) References Cited

U.S. PATENT DOCUMENTS

2005/0211147 A1* 9/2005 Waterfield ..... 112/475.18

* cited by examiner

*Primary Examiner* — Alexander Thomas
(74) *Attorney, Agent, or Firm* — Ober, Kaler, Grimes & Shriver; Royal W. Craig

(57) ABSTRACT

A heat-seal appliqué and method for production that provides numbers, letters, logos, graphics, and other indicia which do not change the physical and visual characteristics of the garment to which it is applied, including breathable and/or moisture-wicking characteristics. The appliqué comprises a perimeter textile having a thermally activated adhesive coating and an interior opening, and a textile inlay that fits within the interior opening of the perimeter textile. The adhesive coating on the perimeter textile is the only adhesive on the appliqué. The appliqué can be heat-sealed to any garment by the perimeter textile, leaving the inlay suspended over the garment without obstructing any performance characteristics of the garment or textile. The appliqué is particularly well-suited for lightweight, breathable and/or moisture-wicking textiles commonly used in performance sports apparel.

4 Claims, 7 Drawing Sheets

HEAT SEALED APPLIQUÉ HAVING ADHESIVE COATED PERIMETER

CROSS-REFERENCE TO RELATED APPLICATION(S)

The present application derives priority from U.S. provisional application Ser. No. 61/216,350 filed 15 May 2009.

BACKGROUND OF THE INVENTION

1. Field of the Invention

The present invention relates to an appliqué that can be applied to a variety of textiles and garments and, particularly, to an appliqué that has a thermally activated adhesive layer only along the outer perimeter of the appliqué.

2. Description of the Background

Manufacturers of fashion apparel, basic apparel, performance apparel, uniforms, swimwear, intimate apparel, and accessories use various methods to apply a variety of indicia, such as text, numbers, logos, graphics, and other indicia, to garments and textiles for decoration and identification, among other things. Common application technologies include silk-screening, screen-printing, sonic welding, direct embroidery, and heat activated transfers. Despite the foregoing alternatives, attaching separate appliqués to the garments and textiles has become the predominant method for applying decoration and identification.

Apparel manufacturers often use thermally activated adhesive coatings to apply these separate appliqués to garments and textiles. One common type of appliqué, typical of sports jersey and uniform numbering and lettering, is a layered appliqué comprising a solid first base layer that defines a numeral or letter and one or more top layers that are the same shape, but smaller than the layer below it, thereby creating a three dimensional appearance. Typically, each additional top layer is stitched to the layer below it. On the back of the solid base layer is a layer of thermally activated adhesive that covers the entire back surface. The solid fabric layers in combination with the solid adhesive coating result in a rigid, thick and relatively heavy, and moisture/air impermeable appliqué. Thus, when such an appliqué is applied to a substrate that is more flexible, lighter, or more breathable than the appliqué itself, the substrate's characteristics are lost. This is a significant disadvantage, especially in the context of performance apparel with moisture-wicking and/or breathability characteristics, because the appliqué undermines the garment's comfort and performance. In addition to unfavorably changing the physical characteristics of the substrate, these appliqués also change the substrate's visual characteristics, such as the amount of drape. It would be greatly advantageous to provide a heat sealed appliqué that can be applied to any garment or textile without obstructing any performance characteristics of the garment or textile, and which is therefore particularly well-suited for lightweight, breathable and/or moisture-wicking textiles commonly used in performance sports apparel.

SUMMARY OF THE INVENTION

It is, therefore, an object of the present invention to provide a heat sealed appliqué forming indicia such as text, numbers, logos, graphics, and other indicia that does not change the physical characteristics, such as stiffness, pliability, breathability, moisture-wicking properties, or weight of the substrate to which the appliqué is applied.

It is another object of the present invention to provide a heat sealed appliqué that does not change the visual characteristics, such as drape, of the substrate to which the appliqué is applied.

It is yet another object of the present invention to provide a heat sealed appliqué that resembles a traditional, layered appliqué often used for lettering and numbering on sports jerseys and uniforms.

And it is another object of the present invention to provide a heat sealed appliqué that can be manufactured cost effectively.

According to the present invention, the above-described and other objects are accomplished, by an appliqué comprising an outer perimeter textile having a thermally activated adhesive coating and a center textile that is uncoated. The adhesive coating does not substantially affect the flexibility, breathability, and weight of the appliqué because the adhesive coating is only around the outer perimeter of the appliqué, and thus the appliqué will not substantially change the physical and visual characteristics of the substrate to which the appliqué is applied. The layered appearance is created by stitching the seam between the perimeter textile and the center textile.

Such an appliqué is manufactured by applying a thermally activated adhesive layer to one side of a perimeter textile, and applying a carrier sheet to the other side. The coated perimeter textile is kiss cut—the carrier layer is not cut—to form a predetermined indicia pattern that may include multiple discrete letters, numbers, graphics, logos or other indicia. In addition to the indicia pattern, an outline cut through the coated perimeter textile and the carrier sheet is made around the complete indicia grouping. The inner excess perimeter textile is removed to form an opening in the shape of the indicia pattern.

The center textile, a separate textile, is cut to conform to the opening in the perimeter textile. The cut center textile is inlayed within the opening in the perimeter textile, and against the carrier sheet. Afterwards, the inlayed center textile is bonded to the perimeter textile by heat pressing, on top and bottom, which partially melts the adhesive coating on the perimeter textile.

The combined perimeter textile and center textile are applied to a backing material to provide the proper body and support for stitching the two textiles together. The carrier sheet is peeled off, and the seam between the two textiles is stitched. After stitching, the bonded perimeter textile and center textile is peeled away from the backing material, leaving the backing material attached under the center textile. The perimeter textile is then cut to define the outer edge of the appliqué. To apply the appliqué, the backing material underneath the center textile is removed, and the appliqué is placed on the garment and heat pressed to activate the adhesive coating. Using this process, the appliqué only has an adhesive layer around its outer perimeter, leaving the center portion uncoated.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a heat sealed appliqué 100 that does not change the physical characteristics, such as stiffness, pliability, breathability, and weight, of the substrate to which the appliqué is applied, as well as the method for production thereof. In an embodiment, the appliqué 100 comprises a perimeter textile having a thermal adhesive coating and an uncoated center textile inlay.

Figure 1:
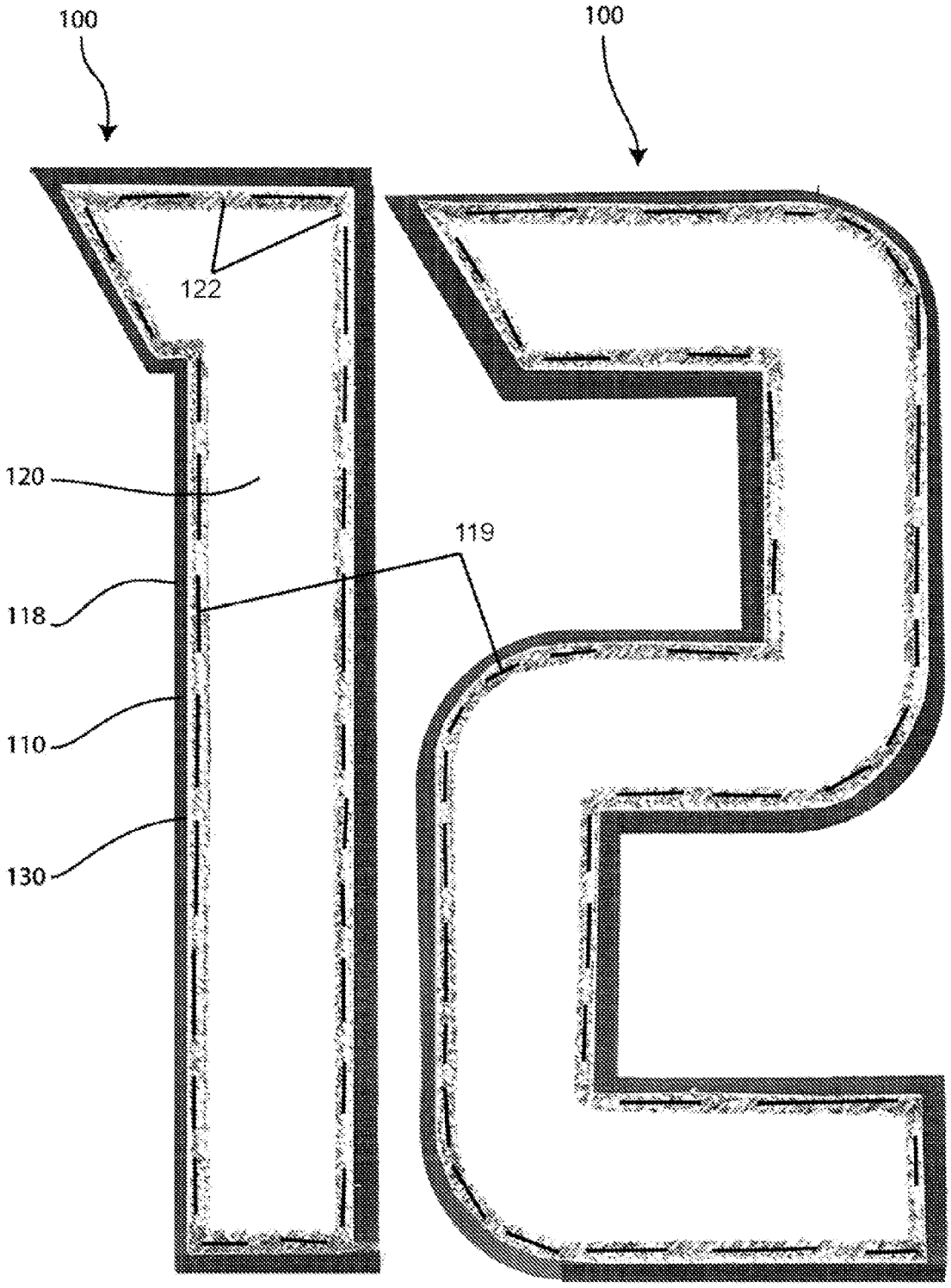
FIG. 1 is a top view of an appliqué 100, according to the present invention.

FIG. 1 is a top view of an appliqué 100 according to the present invention. The perimeter textile 110 is the outermost portion of the appliqué 100 having an outer edge 118 and an inner edge 119 (shown in dotted lines in FIG. 1, see also FIGS. 3 & 5). The outer edge 118 of perimeter textile 110 defines a desired indicia design, and the inner edge 119 defines an opening within the perimeter textile 110, preferably also in the shape of the desired indicia design. The perimeter textile 110 provides the appearance of the solid bottom layer of a traditional multi-layered appliqué. As a matter of design choice, the perimeter textile 110 may be any textile fabric—woven, non-woven, or knitted—formed of any fibrous material—animal, plant, mineral, or synthetic fibers. In a preferred embodiment, the perimeter textile 110 is woven fabric from among the group of polyester, rayon, or nylon twill.

A thermally activated adhesive coating is applied to one side of the perimeter textile 110. The adhesive coating should be one that works well with the chosen perimeter textile, fits the manufacturing process, works with the selected garment, and provides the required performance characteristics after bonding. For example, the adhesive coating may be a thermoplastic, such as a polyester, polyurethane, polyimide, or polyolefin film laminated on one side of the perimeter textile 110.

The center textile 120 is an inlay that fits within the opening defined by the perimeter textile's inner edge 119. Accordingly, the inlay textile 120 is shaped to substantially match the inner edge's periphery. The inlay textile 120 provides the appearance of the solid second layer of a traditional multilayered appliqué. As a matter of design choice, the inlay textile 120 may be any type of any textile fabric—woven, non-woven, or knitted—formed of any fibrous material—animal, plant, mineral, or synthetic fibers. In a preferred embodiment, the inlay textile 120 is a loosely woven mesh or a moisture wicking breathable woven fabric used for high performance sports apparel, such as a nylon or polyester and spandex blend. Typical moisture wicking breathable performance fabrics are knit or woven and comprise between 9% and 33% spandex, the balance being polyester or nylon threads. The inlay textile 120 matches the performance characteristics of the substrate and is not coated with the adhesive coating. Moreover, the perimeter textile 110 is frame-like and does not occupy substantial area. Consequently, the performance characteristics of the substrate to which the appliqué is applied are substantially maintained. For an appliqué that resembles a traditional three or more layered appliqué, the inlay textile 120 may be cut to define yet another opening for insertion of a second, separate inlay textile. Like the first inlay textile 120, the second inlay textile is not coated with an adhesive. This process can be repeated until the desired layered appearance is accomplished. Similarly, the inlay textile 120 need not be unbroken, but can be can be segmented (a patchwork) to achieve a particular designs seen in FIG. 1 the first inlay textile 120 is secured to the perimeter textile 110, preferably on both sides by a combination of thermal bonding and sewing. The thermal bonding is optional but preferred. For this, the thermally activated adhesive coating on the perimeter textile 110 is bonded to the first inlay textile 120 by fusing about the interface between the inner edge 119 of perimeter textile 110 and the mating outer edge of inlay textile 120. On the other side, an embroidery cross-stitch is used to sew the perimeter textile 110 to the first inlay textile 120. This dual attachment provides a much stronger appliqué able to withstand repeated laundering. Any inner second or third inlay textiles are attached only by sewing. To apply the heat sealed appliqué 100 to a desired garment, the appliqué is placed on the garment in the desired position and is hot pressed, resulting in bonding of the perimeter textile 110 to the substrate Since the adhesive only resides on the surrounding perimeter textile 110 of the appliqué 100, the inlay textile 120 is suspended over the substrate, and the appliqué as a whole remains flexible and does not affect the physical characteristics of the garment when applied.

Figure 2:
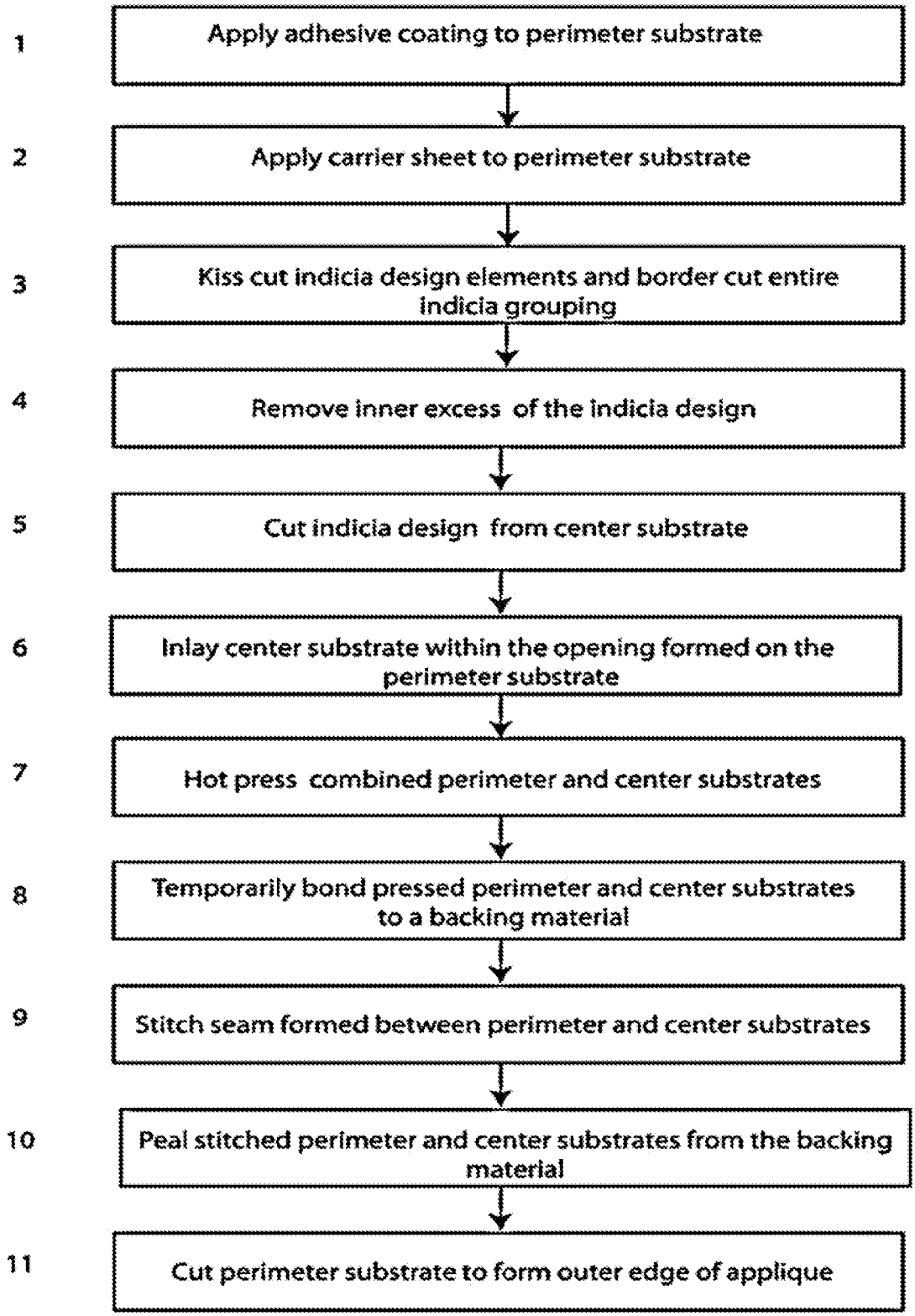
FIG. 2 is a flow chart illustrating a process to manufacture an appliqué 100, according to the present invention.

The heat-sealed appliqué 100 of the present invention can be manufactured by using the process described below. FIG. 2 is a flow chart illustrating a preferred process for manufacturing appliqué 100, in accordance with the present invention. The process begins with the perimeter textile 110 in bulk sheet or roll form In Step 1, the thermally activated adhesive layer is applied to one side of the perimeter textile 110. In an embodiment, the adhesive layer is a thermoplastic film that is applied by using a belt-driven laminator. However, other machines such as a heat press machine or calendar machine may be used. The thermoplastic film may be polyurethane (TPU), polyester, polyamide, polyolefin or aliphatic urethanes, the particular type of adhesive used being selected to provide optimum performance characteristics for specific applications, as one skilled in the art of thermal transfers would appreciate.

In Step 2, after applying the adhesive layer, a carrier sheet 111 is temporarily bonded to the uncoated side of the perimeter textile 110 using a temporary low tack, low residue pressure sensitive adhesive. The pressure sensitive adhesive may be pre-applied to the carrier sheet 111, which is in turn applied by using a roller. The carrier sheet 111 provides additional support and secures the textile components during the manufacturing process. The carrier sheet 111 may comprise any material durable enough to withstand the manufacturing process. In an embodiment, the carrier sheet 111 is a clear plastic sheet such as cellophane, although any suitable translucent or transparent carrier layer that remains stable at elevated heat-seal temperatures.

Figure 3:
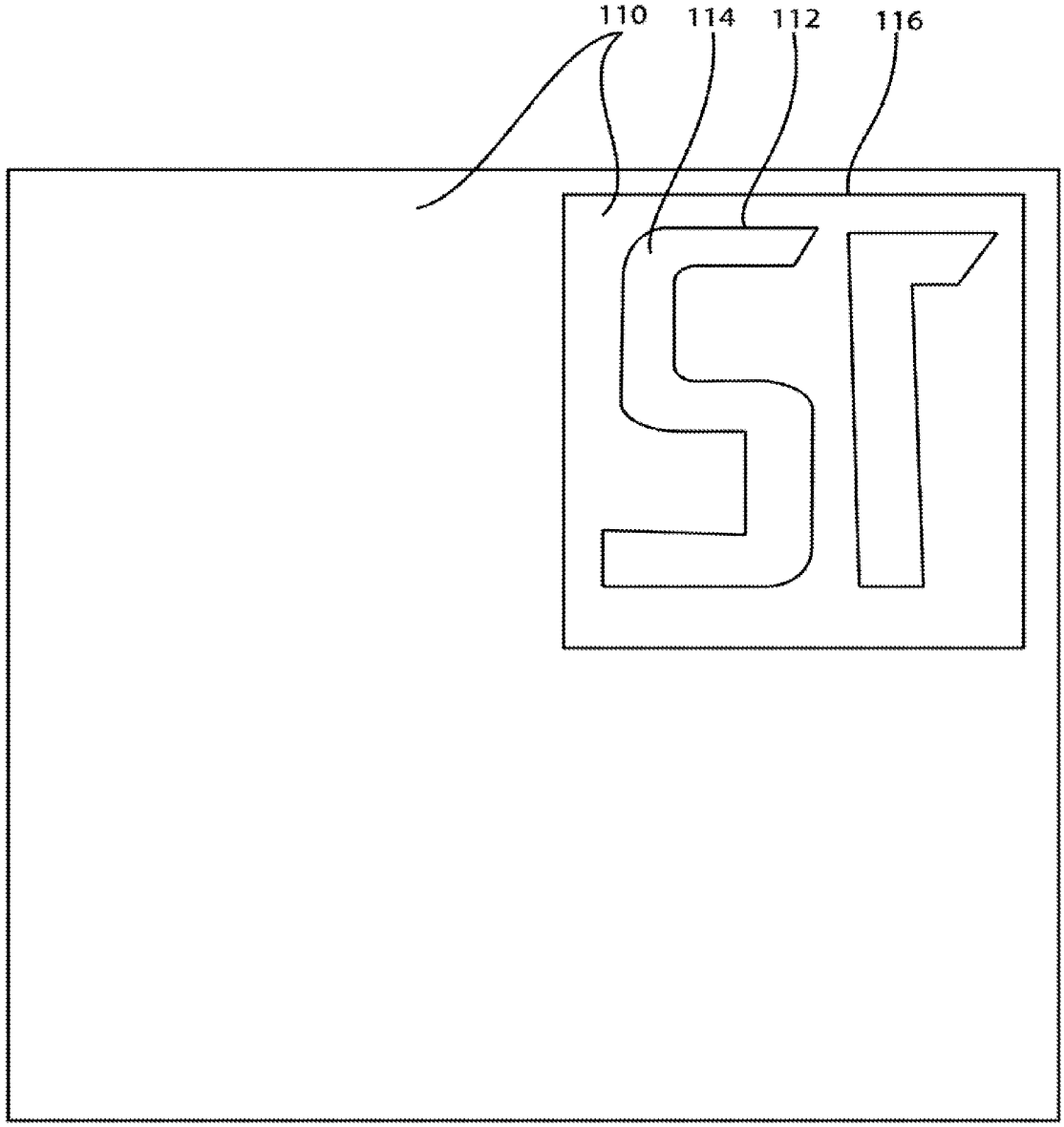
FIG. 3 is a top view of the perimeter textile after the kiss and outline cuts have been made.
Figure 4:
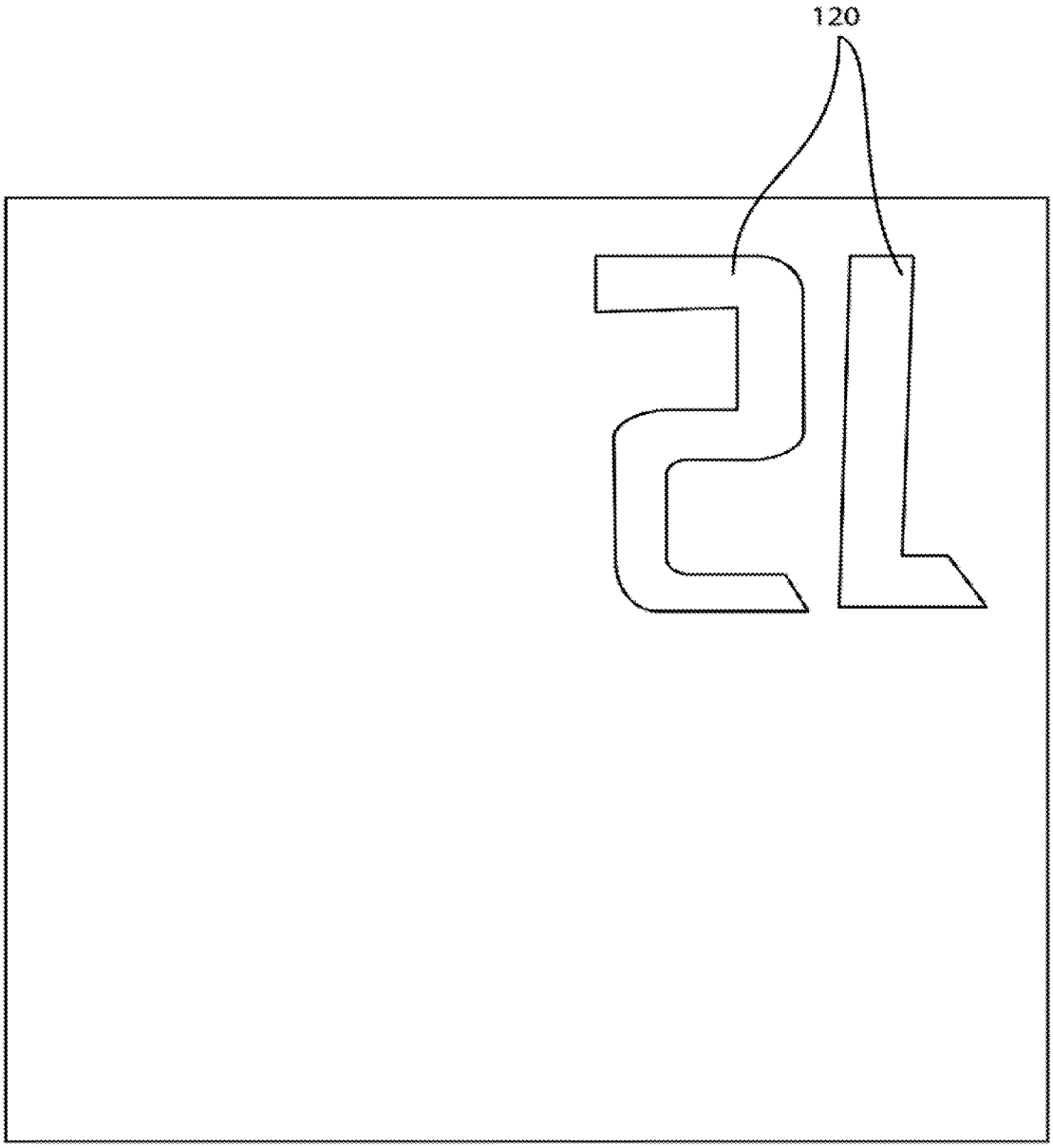
FIG. 4 is a top view of the center textile after the indicia pattern has been made.

In Step 3, the coated perimeter textile 110 is kiss cut (the carrier layer 111 is not cut) to form a predetermined indicia pattern that may include discrete letters, numbers, graphics, logos or other indicia. An indicia grouping may be formed by kiss-cutting multiple indicia into the coated perimeter textile 110, such as discrete numbers one and two as shown in FIG. 1. In addition to the indicia pattern, an outline cut 118 through the coated perimeter textile 110 and the carrier sheet 111 is made around the indicia or complete indicia grouping. The kiss cut 112 and outline cut 116 are illustrated in FIG. 3. Both kiss-cut 112 and outline cut 116 may be accomplished using a laser cutter, hot knife, or any other device capable of selectively cutting to a desired depth through the coated perimeter textile 110 with and without cutting the carrier sheet 111. If a laser cutter is used, the assembly—the coated perimeter textile 110 and carrier sheet 111—is placed on the laser bed with the carrier sheet 111 down, and a reverse image of the indicia pattern (or indicia grouping) is kiss cut. At Step 4, the inner excess 114 of the kiss cut pattern is removed from the carrier sheet 111 to expose that area of carrier sheet 111 as well as the inner edge 119 of the perimeter textile 110, thereby forming an opening in the shape of the indicia pattern. Subsequently, at Step 5, a separate fabric is cut to form the textile 120 inlay that corresponds to the shape defined by the perimeter textile's inner edge 119, as illustrated in FIG. 4. Cutting may be accomplished using a laser cutter, hot knife, or any other device capable of cutting the inlay textile fabric, and in an embodiment, a laser cutter is used.

Figure 5:
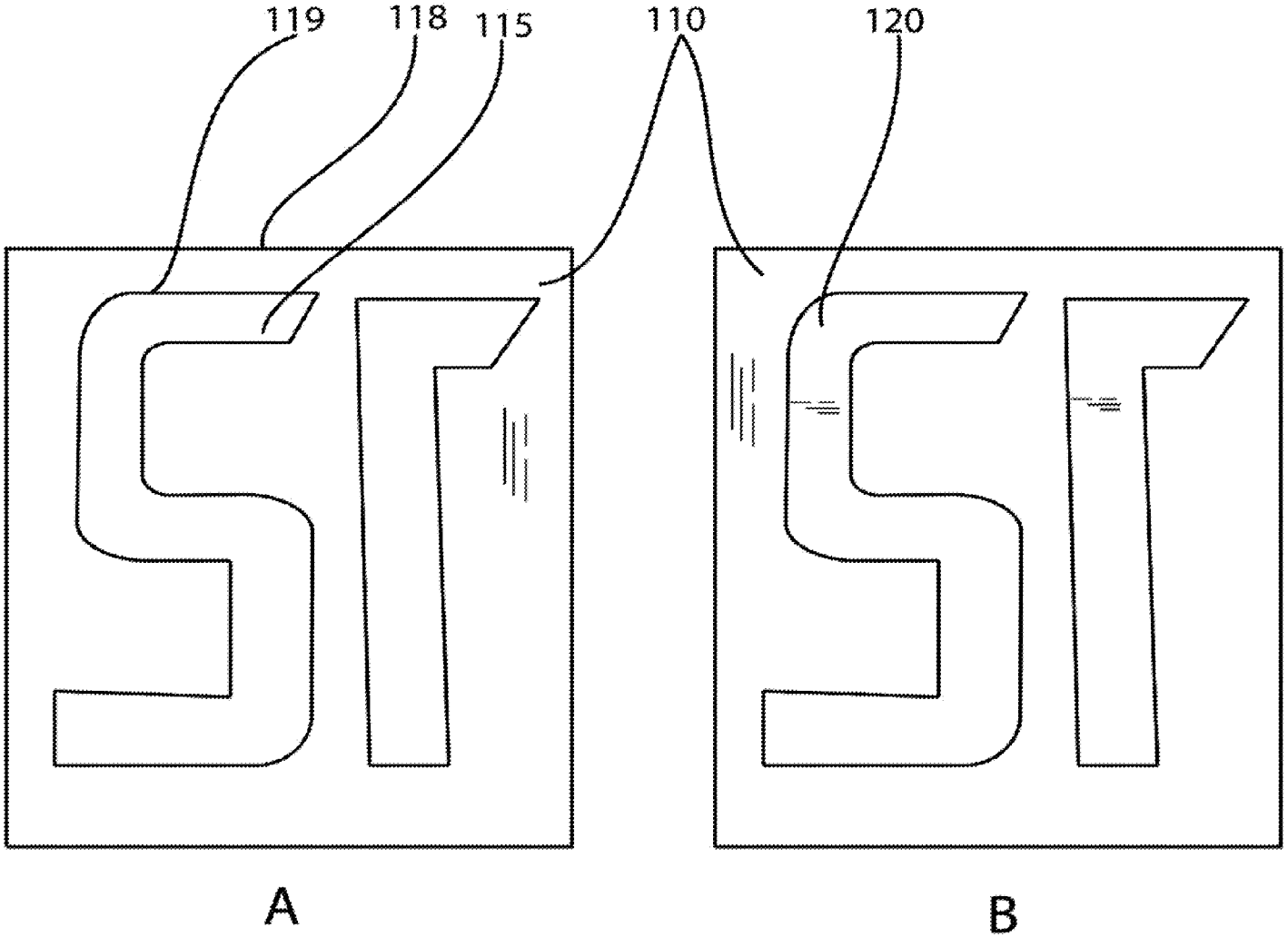
FIG. 5A is a top view of the perimeter textile without the center textile inlay.
FIG. 5B is a top view of the perimeter textile with the center textile inlay.

At Step 6, the inlay textile 20 is inlayed within the opening 115 in the coated perimeter textile 110 and against the carrier sheet 111, as illustrated in FIG. 5. In an embodiment, the inlay textile 120 is slightly larger than the opening 115 to prevent any gaps between the perimeter textile 110 and the inlay textile 120.

At Step 7, the inlay textile 120 is bonded to the perimeter textile 130 by heat pressing the combined assembly to partially melt the adhesive coating on the perimeter textile. The combined heat and pressure partially fuses the thermal adhesive layer around the inner edges 119 of the perimeter textile 130 to the conforming outer edges of the textile inlay 120. This step helps the appliqué maintain its physical integrity by providing an attachment means in addition to the stitching described below. This step is optional, however, and may be omitted from the process if quality is not a concern.

Figure 6:
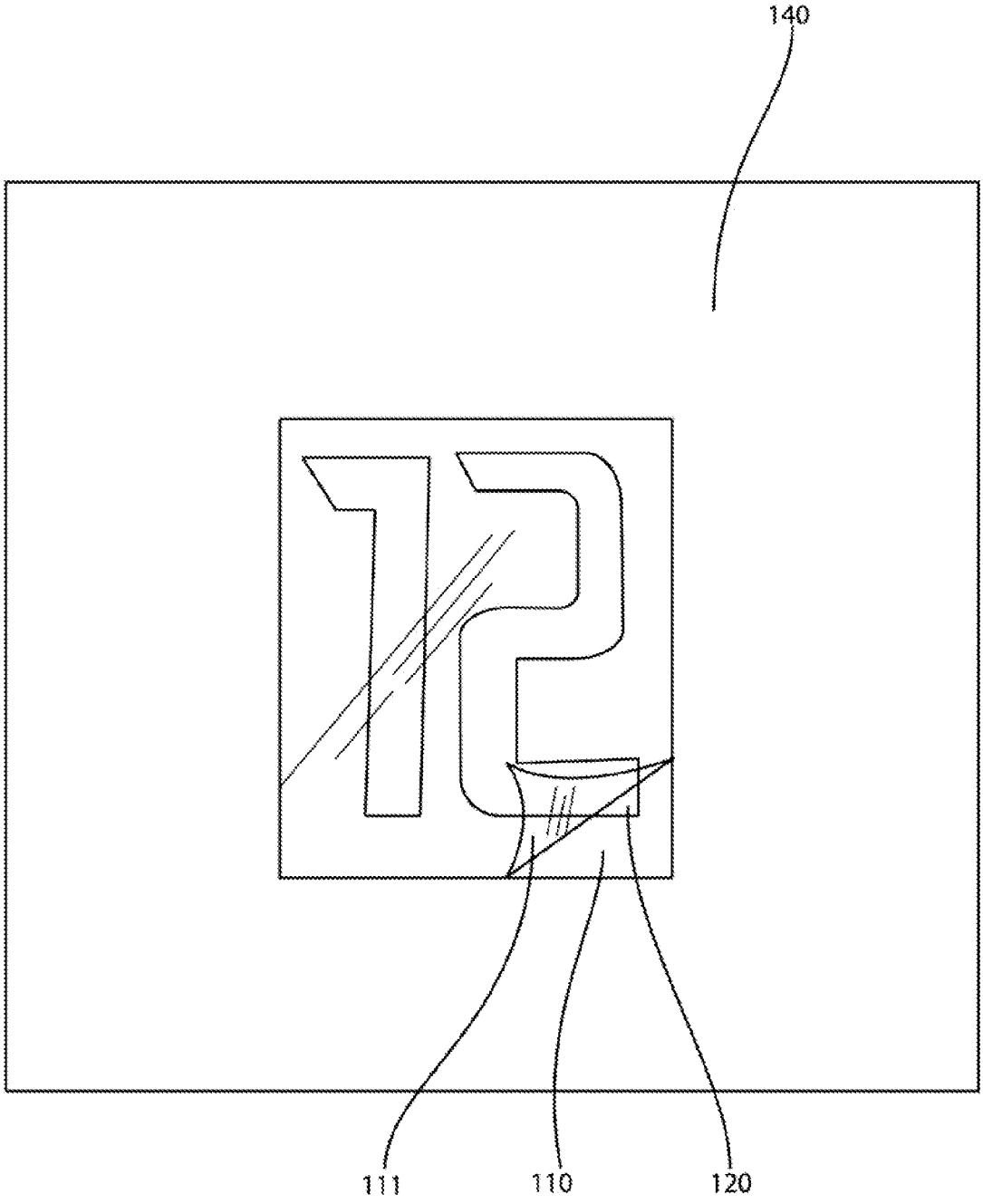
FIG. 6 is a top view of the combined perimeter and center textiles when placed on the backing material.
Figure 7:
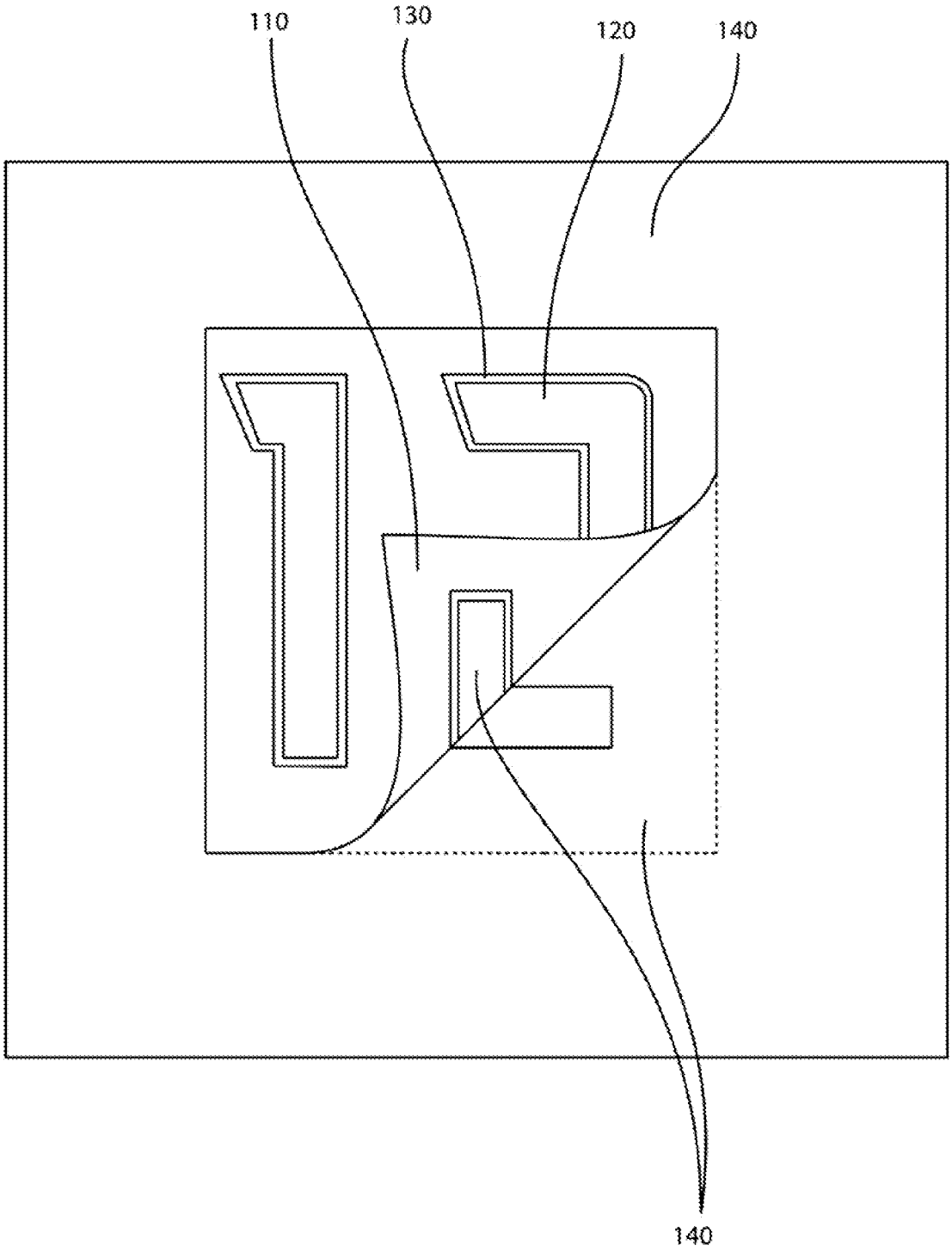
FIG. 7 is a top view of the combined perimeter and center textiles being peeled off the backing material after being stitched.

At Step 8 (FIG. 6), to provide the proper body and support while stitching the seam formed by the abutting perimeter textile 110 and the inlay textile 120, the bonded perimeter textile and inlay textile are applied to a backing material 140, with the carrier sheet 111 facing away from the backing material. For example, the backing material 140 may be tear-away Pellon™. The bonded assembly is applied to the backing material 140 by using a temporary pressure sensitive adhesive. To ensure proper machine orientation for the stitch work, the bonded perimeter textile 110 and inlay textile 120 are aligned with an outline stitch on the backing material that matches the dimensions of the outline cut 118 of the perimeter textile. Once placed on the backing material 140 and the carrier layer 111 is removed, the seam formed by the abutting perimeter textile and inlay textile is sewn with the desired stitch pattern 130 at Step 9. The stitching 130 is preferably an embroidery style cross-stitch overlapping both the perimeter textile 110 and the inlay textile 120, further securing the textiles together. At Step 10 after stitching, the bonded perimeter textile 110 and inlay textile 120 is peeled away from the backing material 140, leaving the backing material attached only under the inlay textile.

At Step 11, the stitched and bonded perimeter textile 110 and inlay textile 120 is heat pressed to flatten the combined assembly, and at Step 12, the perimeter textile 130 is cut to form the outermost edge 118 of the indicia pattern to form an appliqué 100. Cutting may be accomplished using a laser cutter, hot knife, or any other device capable of cutting the perimeter textile 130. In an embodiment, a laser cutter is used because it melts the adhesive layer around the outer edge 118, thus preventing fraying.

For an appliqué 100 to provide the appearance of a traditional layered appliqué having three or more layers, after the inlay textile 120 is placed within the opening 115 of the perimeter textile 110 (Step 6), the inlay textile 120 is cut to form an interior opening in a desired shaped (similar to Step 4). A second, separate inlay textile is cut to conform to the opening in the first inlay textile 120, and the second inlay textile is inlayed within the opening in the first inlay textile 120. The process is repeated until the desired layered appearance is achieved. As described above, the combined assembly is then heat pressed to bond the perimeter textile 110 and inlay textile 120 (Step 7) and placed on a backing material (Step 8); the seams of abutting substrates are stitched (Steps 9); the backing material is removed (Step 10); the stitched assembly is heat pressed (Step 11); and the perimeter textile is cut to form the outer perimeter (Step 12).

Using this process, the appliqué 100 has an adhesive layer only around its outer perimeter textile, and the inlay portion is uncoated. To apply the appliqué, the appliqué is placed in its desired position on the garment and heat pressed to activate the adhesive coating.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. An appliqué comprising;

a carrier sheet bearing a temporary pressure sensitive adhesive;

a perimeter textile layer formed in a shape of an indicia pattern and cut with an outer edge delineating said indicia pattern and an inner edge delineating an interior open space in a shape of said indicia pattern, said perimeter textile layer being adhered on one side to said carrier sheet;

a thermal adhesive laminated to another side of said perimeter textile layer;

an inlay textile layer fitted within the interior open space of said perimeter textile; and embroidery cross-stitching along the abutting edges of said inlay textile layer and perimeter textile layer and securing said inlay textile layer and perimeter textile layer together.

2. The appliqué according to claim 1, wherein the thermal adhesive laminated to another side of said perimeter textile layer is heat-fused to said inlay textile layer.

3. The appliqué according to claim 1, wherein the carrier sheet spans the interior open space of said perimeter textile layer.

4. The appliqué according to claim 3, wherein the interior open space of said perimeter textile layer is kiss-cut and removed without cutting said carrier sheet.

* * * * *